US009399353B2

(12) United States Patent
Komatsu et al.

(10) Patent No.: US 9,399,353 B2
(45) Date of Patent: Jul. 26, 2016

(54) LIQUID DISCHARGE APPARATUS AND LIQUID SUPPLY PATH STATE DETECTION METHOD

(71) Applicant: SEIKO EPSON CORPORATION, Tokyo (JP)

(72) Inventors: Shinya Komatsu, Nagano (JP); Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/587,162

(22) Filed: Dec. 31, 2014

(65) Prior Publication Data

US 2015/0191021 A1 Jul. 9, 2015

(30) Foreign Application Priority Data

Jan. 7, 2014 (JP) ..... 2014-000785

(51) Int. Cl.

| | |
|---|---|
| ***B41J 2/175*** | (2006.01) |
| ***B41J 2/045*** | (2006.01) |
| ***B41J 29/38*** | (2006.01) |
| ***B41J 2/18*** | (2006.01) |
| *B41J 2/14* | (2006.01) |

(52) U.S. Cl.

CPC ..... *B41J 2/17566* (2013.01); *B41J 2/0451* (2013.01); *B41J 2/04541* (2013.01); *B41J 2/04581* (2013.01); *B41J 2/14274* (2013.01); *B41J 2/175* (2013.01); *B41J 2/18* (2013.01); *B41J 29/38* (2013.01); *B41J 2002/14354* (2013.01); *B41J 2202/12* (2013.01); *B41J 2202/20* (2013.01)

(58) Field of Classification Search

CPC ..... B41J 2002/17583

See application file for complete search history.

(56) References Cited

U.S. PATENT DOCUMENTS

| | | | | |
|---|---|---|---|---|
| 7,300,131 | B2 | 11/2007 | Sakagami et al. | |
| 7,328,962 | B2 | 2/2008 | Higuchi et al. | |
| 7,475,960 | B2 | 1/2009 | Oku | |
| 2005/0212846 | A1 | 9/2005 | Shinkawa et al. | |
| 2006/0012645 | A1 * | 1/2006 | Nagashima | 347/68 |
| 2009/0058920 | A1 * | 3/2009 | Endo et al. | 347/19 |
| 2009/0278880 | A1 * | 11/2009 | Dijksman et al. | 347/14 |

FOREIGN PATENT DOCUMENTS

| | | | |
|---|---|---|---|
| JP | 01-150549 | A | 6/1989 |
| JP | 04-029851 | A | 1/1992 |
| JP | 2005-153152 | A | 6/2005 |
| JP | 2006-123539 | A | 5/2006 |
| JP | 2006-218872 | A | 8/2006 |
| JP | 2006-312329 | A | 11/2006 |

OTHER PUBLICATIONS

The Extended European Search Report for the corresponding European Application No. 15150276.2 dated May 19, 2015.

* cited by examiner

*Primary Examiner* — Shelby Fidler

(74) *Attorney, Agent, or Firm* — Global IP Counselors, LLP

(57) ABSTRACT

A liquid discharge apparatus is provided with a cavity which is configured to be filled with an ink, an ink supply path configured to supply the ink to the cavity, a nozzle linked with the cavity and configured to discharge the ink which is filled into the cavity, and a detecting section configured to detect the state of the ink supply path which is supplied based on the amount of the ink which is filled into a plurality of the nozzles.

8 Claims, 9 Drawing Sheets

LIQUID DISCHARGE APPARATUS AND LIQUID SUPPLY PATH STATE DETECTION METHOD

CROSS-REFERENCE TO RELATED APPLICATIONS

This application claims priority to Japanese Patent Application No. 2014-000785 filed on Jan. 7, 2014. The entire disclosure of Japanese Patent Application No. 2014-000785 is hereby incorporated herein by reference.

BACKGROUND

1. Technical Field

The present invention relates to a liquid discharge apparatus and a liquid supply path state detection method.

2. Related Art

Among ink jet printers which are liquid discharge apparatuses, for example, a means for detecting residual vibration in a cavity after a liquid droplet discharge operation using an actuator and for detecting discharge abnormalities in a liquid droplet discharge head based on a vibration pattern which is detected and a liquid droplet discharge apparatus (an ink jet printer) which is provided with this means are known as described in Japanese Unexamined Patent Application Publication No. 2006-218872. Due to this detecting means, it is possible to detect an abnormality in nozzle units without the need for an apparatus for detecting discharge abnormalities, and further, it is possible to detect discharge abnormalities even during a printing operation.

However, even though it is possible for the liquid droplet discharge apparatus described in Japanese Unexamined Patent Application Publication No. 2006-218872 to detect discharge abnormalities which are caused by the state of the cavities (pressure chambers for discharging liquid droplets) or the nozzles, there is a problem that it is not possible to detect abnormalities in a liquid supply path which supplies a liquid to the cavities. There are discharge abnormalities which are caused when there are abnormalities in the liquid supply path. For example, there is an abnormality in pressure in the ink supply path due to bubbles or the like being mixed or generated in the liquid supply path, ink leaking from the nozzle which is caused by an abnormality in pressure in the ink supply path, and the like.

SUMMARY

The present invention is carried out to solve the problems described above and is able to be realized as the following applied examples or embodiments.

A liquid discharge apparatus according to the present applied example is provided with a cavity configured to be filled with a liquid, a liquid supply path configured to supply the liquid to the cavity, a plurality of nozzles each of which is linked with the cavity and is configured to discharge the liquid which is filled into the cavity, and a detecting section configured to detect a state of the liquid supply path based on an amount of the liquid which is filled into the nozzles.

With the configuration as in the liquid discharge apparatus of the present applied example, the liquid leaks from a portion of the nozzles when there is any abnormality in the liquid supply path. At this time, the amount of the liquid in the nozzles in the portion of the nozzles where the liquid leaks is different to the amount of the liquid in the many other nozzles. Accordingly, it is possible to detect abnormalities in the liquid supply path by detecting the state of the liquid supply path based on the amount of the liquid which is filled into the nozzles.

A liquid discharge apparatus according to the present applied example is provided with a discharge section configured to discharge a liquid which is filled into a plurality of cavities due to a capacity of the cavities changing according to vibrating of a vibration plate which is vibrated by a piezoelectric element, a retaining section configured to retain the liquid, a liquid supply path configured to supply the liquid from the retaining section to the cavities, and a detecting section configured to detect a state of the liquid supply path based on residual vibration in the vibration plate.

With the configuration as in the liquid discharge apparatus of the present applied example, ink leaks from a portion of the nozzles when there is any abnormality in the liquid supply path. At this time, the amount of the liquid in the nozzles in the portion of the nozzles where the liquid leaks is different to the amount of the liquid in the many other nozzles. When the amount of the liquid in the nozzles is different, inertance of the liquid in the nozzles changes and there is a change in the residual vibration in the vibration plate (the residual vibration pattern in the vibration plate) in the cavity which is linked the nozzle. Accordingly, it is possible to detect abnormalities in the liquid supply path by detecting the state of the liquid supply path based on the residual vibration in the vibration plate.

In the liquid discharge apparatus according to the applied example described above, the detecting section is configured to detect the state of the liquid supply path based on a period of the residual vibration.

The period of the residual vibration with regard to vibrating of the vibration plate where the capacity of the cavity which is linked with the nozzle changes when there is a change in the inertance of the liquid which is filled into the nozzle. For this reason, as in the present applied example, changes in inertance of the liquid which is filled into the nozzle (that is, the change in the amount of the liquid which is filled into the nozzle) are known by observing variation in the period of the residual vibration. That is, it is possible to more simply detect changes in the state of the liquid supply path which produces these changes.

In the liquid discharge apparatus according to the applied example described above, the discharge section is further configured to move to a standby position in a case where the liquid is not discharged onto a medium and the detecting section is configured to detect the state of the liquid supply path before starting movement of the discharge section from the standby position to another position.

According to the present applied example, the detecting section detects the state of the liquid supply path before starting movement of the discharge section from the standby position to another position. For this reason, for example, in a case where an abnormality in pressure in the liquid supply path is detected, there is a danger that liquid leaks from the nozzle or the like, but since this occurs before starting movement of the discharge section from the standby position to another position, it is possible to take precautions against the medium becoming unclean due to the liquid which leaks and locations outside of the standby position becoming unclean.

The liquid discharge apparatus according to the applied example described above is further provided with a manifold linked with the cavities and a pump configured to pump the liquid which is filled into the liquid supply path, and the liquid supply path has a circulation path which includes an outward path from the retaining section to the manifold and a return path from the manifold to the retaining section, and the pump is further configured to increase a speed for pumping of the liquid in a case where the detecting section determines that the state of the liquid supply path is abnormal.

According to the present applied example, the liquid supply path has the circulation path which includes the outward path from the retaining section to the manifold and the return path from the manifold to the retaining section, and the pump pumps the liquid in the circulation path. In addition, the pump increases the speed for pumping of the liquid in a case where the detecting section determines that the state of the liquid supply path is abnormal. Accordingly, in a case where, for example, bubbles are included in the liquid supply path and the detecting section detects an abnormality in the liquid supply path which is caused by the bubbles (an abnormality where a predetermined pressure is exceeded), it is possible to circulate the bubbles which are included in an inner section of the liquid supply path within the circulation path and move the bubbles to the retaining section by increasing the speed for pumping of the liquid in the liquid supply path. As a result, it is possible to return the state of the liquid supply path to a favorable state.

The liquid discharge apparatus according to the applied example described above is further provided with a pressurizing section configured to pressurize the liquid which is filled into the liquid supply path, and the pressurizing section is configured to pressurize the liquid which is filled into the liquid supply path in a case where the detecting section determines the state of the liquid supply path is abnormal.

According to the present applied example, the pressurizing section pressurizes the liquid which is filled into the liquid supply path in a case where the detecting section determines the state of the liquid supply path is abnormal. Accordingly, in a case where, for example, bubbles are included in the liquid supply path and the detecting section detects an abnormality in the liquid supply path which is caused by the bubbles (an abnormality where a predetermined pressure is exceeded), it is possible to eject bubbles, which move from the circulation path to the cavity and the nozzle, from the nozzle by pressurizing the liquid which is filled into the liquid supply path. As a result, it is possible to return the state of the liquid supply path to a favorable state in combination with eliminating bubbles from within the circulation path.

A liquid supply path state detection method according to the present applied example using a liquid discharge apparatus which is provided with a cavity configured to be filled with a liquid, a liquid supply path configured to supply the liquid to the cavity, and a plurality of nozzles each of which is linked with the cavity and is configured to discharge the liquid which is filled into the cavity, includes detecting a state of the liquid supply path based on an amount of the liquid which is filled into a plurality of the nozzles.

In the liquid discharge apparatus according to the liquid supply path state detection method of the present applied example, the liquid leaks from a portion of the nozzles in a case where there is any abnormality in the liquid supply path. At this time, the amount of the liquid in the nozzles in the portion of the nozzles where the liquid leaks is different to the amount of the liquid in the many other nozzles. When the amount of the liquid in the nozzles is different, inertance of the liquid in the nozzles changes and there is a change in the residual vibration in the vibration plate (the residual vibration pattern in the vibration plate) in the cavity which is linked with the nozzle. Accordingly, it is possible to detect abnormalities in the liquid supply path by detecting the state of the liquid supply path based on the residual vibration in the vibration plate.

A liquid supply path state detection method according to the present applied example using a liquid discharge apparatus provided with a discharge section configured to discharge a liquid which is filled into a cavity due to the capacity of the cavity changing according to vibrating of a vibration plate which is vibrated by a piezoelectric element, a retaining section configured to retain the liquid, and a liquid supply path configured to supply the liquid from the retaining section to the cavity, includes detecting a state of the liquid supply path based on residual vibration in the vibration plate.

In the liquid discharge apparatus according to the liquid supply path state detection method of the present applied example, the liquid leaks from a portion of the nozzles in a case where there is any abnormality in the liquid supply path. At this time, the amount of the liquid in the nozzles in the portion of the nozzles where the liquid leaks is different to the amount of the liquid in the many other nozzles. When the amount of the liquid in the nozzles is different, inertance of the liquid in the nozzles changes and there is a change in the residual vibration in the vibration plate (the residual vibration pattern in the vibration plate) in the cavity which is linked with the nozzle. Accordingly, it is possible to detect abnormalities in the liquid supply path by detecting the state of the liquid supply path based on the residual vibration in the vibration plate.

BRIEF DESCRIPTION OF THE DRAWINGS

Referring now to the attached drawings which form a part of this original disclosure.

DETAILED DESCRIPTION OF EXEMPLARY EMBODIMENTS

A specific embodiment of the present invention will be described below with reference to the drawings. Below is an embodiment of the present invention, but the present invention is not limited to this. Here, there are cases in each of the following drawings where the dimensions are drawn to be different to the actual dimensions in order for the description to be easy to understand.

Embodiment 1

Figure 1A:
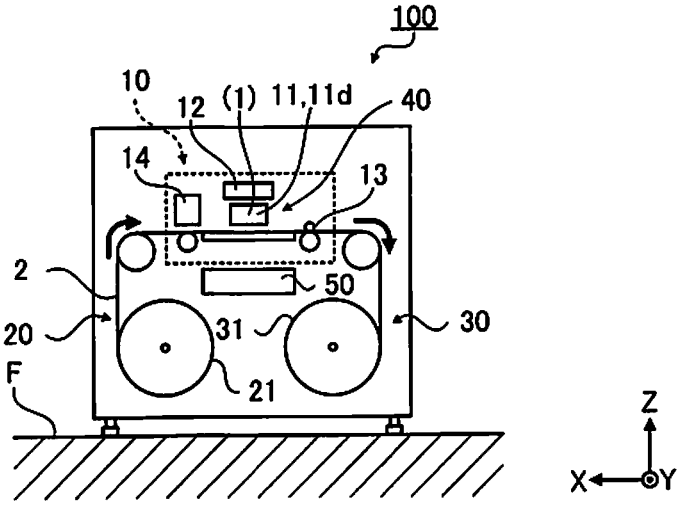
FIG. 1A is a front surface diagram.
Figure 1B:
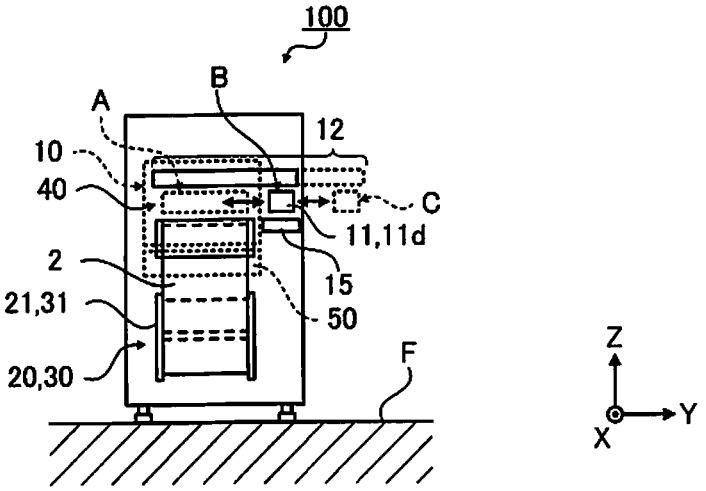
FIG. 1B is a side surface diagram schematically illustrating a liquid discharge apparatus according to embodiment 1.

FIG. 1A is a front surface diagram and FIG. 1B is a side surface diagram which schematically illustrate an ink jet printer 100 which is a liquid discharge apparatus according to embodiment 1.

In FIGS. 1A and 1B, the Z axis direction is the up and down direction and the −Z direction is the downward direction, the Y axis direction is the forward and backward direction and the +Y direction is the forward direction, the X axis direction is the left and right direction and the +X direction is the leftward direction, and the X-Y plane is a surface which is parallel with a floor F on which the ink jet printer 100 is arranged.

The ink jet printer 100 is an ink jet printer which records an image on a paper roll 2 which is a "medium" which is supplied in a state of being wound in a roll form by discharging an ink 1 which is a "liquid", and is configured from a recording section 10, a supply section 20, a housing section 30, a detecting section 40, a control section 50, and the like.

The recording section 10 is a portion which forms (prints) an image on the paper roll 2 according to image information which is provided by the control section 50, and is provided with discharge heads 11 which are a "discharge section" which discharges the ink 1 onto the surface of the paper roll 2, a head driver 11*d* which is a "driving section" which drives the discharge heads 11, a head moving mechanism 12, a driving roller 13, an ink tank 14 which is a "retaining section", and the like.

A plurality of the discharge heads 11 are provided for each type of the ink 1 which is discharged and one of the head units 19 (which will be described later) is configured by the plurality of discharge heads 11 which discharge the same type of the ink 1. As the types of the ink 1, for example, yellow, magenta, cyan, black, clear, and the like are used. Accordingly, the discharge section is configured by five of the head units 19 in this case. Here, the discharge heads 11 (the head units 19) may be either of a line head system which is aligned so as to be fixed in the width direction of the paper roll 2 or a serial head system which is mounted on a movable carriage and which discharges the ink 1 while being moved in the width direction of the paper roll 2. The configuration of the discharge heads 11 will be described later.

The head moving mechanism 12 supports the discharge heads 11 (the head units 19) such that it is possible to move between a recording and discharging region A, a non-recording and discharging region B which is a "standby position", and a maintenance region C as shown in FIG. 1B with the object of carrying out maintenance or the like on the discharge heads 11 under control of the control section 50.

The recording and discharging region A is a region which is positioned above the paper roll 2 which is supported on a transfer path and is a region where ink 1 is discharged onto the paper roll 2 by the discharge heads 11 and an image is formed.

The non-recording and discharging region B is a region which is positioned on the Y side of the recording and discharging region A and where cleaning by discharging such as flushing is performed. The non-recording and discharging region B is provided with an ink recovery section 15 which receives and recovers the ink 1 which is discharged from the discharge heads 11.

The maintenance region C is a region which positioned further on the Y side of the non-recording and discharging region B and where it is easy to perform maintenance on the discharge heads 11 using a peripheral space.

The driving roller 13 transfers (moves) the paper roll 2 by rotating using a drive motor (which is not shown in the drawings) which is driven to accompany forming of an image under control of the control section 50.

The ink tank 14 retains the ink 1. The ink 1 which is retained in the ink tank 14 is supplied to the discharge heads 11 using an ink supply path 80 (which will be described later) which is a "liquid supply path". The ink tank 14 and the ink supply path 80 which is linked to the ink tank 14 are independently provided for each type of the ink 1.

The supply section 20 is a medium supply section which houses the paper roll 2 prior to recording, is positioned on the upstream side of the recording section 10 in the transfer path of the paper roll 2, and is provided with a feeding reel 21 or the like on which the paper roll 2 is loaded. The feeding reel 21 feeds the paper roll 2 towards the recording section 10 which is arranged on the downstream side of the supply section 20 by being rotated by a feeding motor (which is not shown in the drawings).

The housing section 30 is a medium housing section which winds in and houses the paper roll 2 after recording, is positioned on the downstream side of the recording section 10 in the transfer path of the paper roll 2, and is provided with a winding reel 31 or the like which winds in the paper roll 2. The winding reel 31 winds in the paper roll 2 which is sent via the recording section 10 which is arranged on the upstream side of the housing section 30 by being rotated by a winding motor (which is not shown in the drawings).

Here, the medium is described with the paper roll 2 as an example, but the medium may be a medium in sheet form. In a case where a medium in sheet form is the target medium, the medium supply section is provided with a supply mechanism which includes a separator in order for the medium to be supplied one sheet at a time to the recording section 10. In addition, the medium housing section is provided with a housing tray or the like for housing the medium which is ejected from the recording section 10 after recording.

Figure 2:
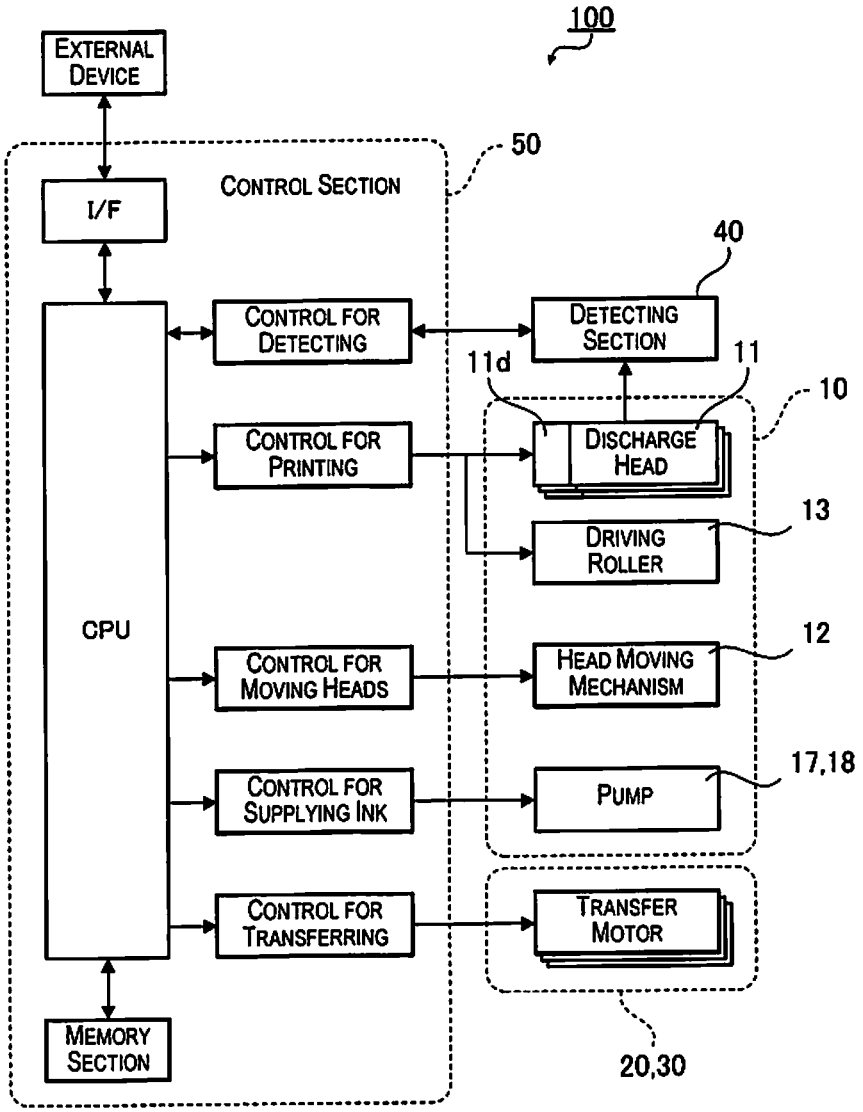
FIG. 2 is a block diagram of the liquid discharge apparatus according to embodiment 1.

FIG. 2 is a block diagram of the ink jet printer 100.

The detecting section 40 is a portion which detects the state of the ink supply path 80 by detecting (observing) the state of the ink 1 in the discharge heads 11 and is controlled by the control section 50. The detecting section 40 will be described later in detail.

The control section 50 is a control unit which performs central control of the ink jet printer 100, has a computation unit (a CPU), an interface (I/F) to communicate with an external apparatus, a memory section, and the like, and performs control for transferring the paper roll 2, control for printing in order to form an image, control for supplying ink to the discharge heads 11, control for detecting the state of the ink supply path 80, control for moving the discharge heads 11, and the like.

The control section 50 receives image information for printing from an external apparatus such as a personal computer or an image processing apparatus in advance via the communication interface (I/F) and stores the information in the memory section.

Control for transferring is performing control of each type of transfer motor in the transfer path which includes the feeding motor, the winding motor, or the like described above and of a position determining mechanism or a holding mechanism (which are not shown in the drawings) for the paper roll 2, and the like.

Control for printing is control for forming an image and is performing control for discharging the ink 1 with regard to the discharge heads 11 at the same time as controlling the driving roller 13 based on the image information.

Control for supplying ink is performing control for driving a pump 17 which pumps the ink 1 within the ink supply path 80, control of a pump 18 which is a "pressurizing section" which performs control to pressurize the ink 1 within the ink supply path 80, and the like.

Control for moving heads is control with regard to movement for performing maintenance on the discharge heads 11 (the head units 19) and the like and is performing control of the head moving mechanism 12 in order to move the discharge heads 11 (the head units 19) between the recording and discharging region A, the non-recording and discharging region B, and the maintenance region C.

Control for detecting is performing control on the detecting section 40 which detects the state of the ink supply path 80.

Figure 3A:
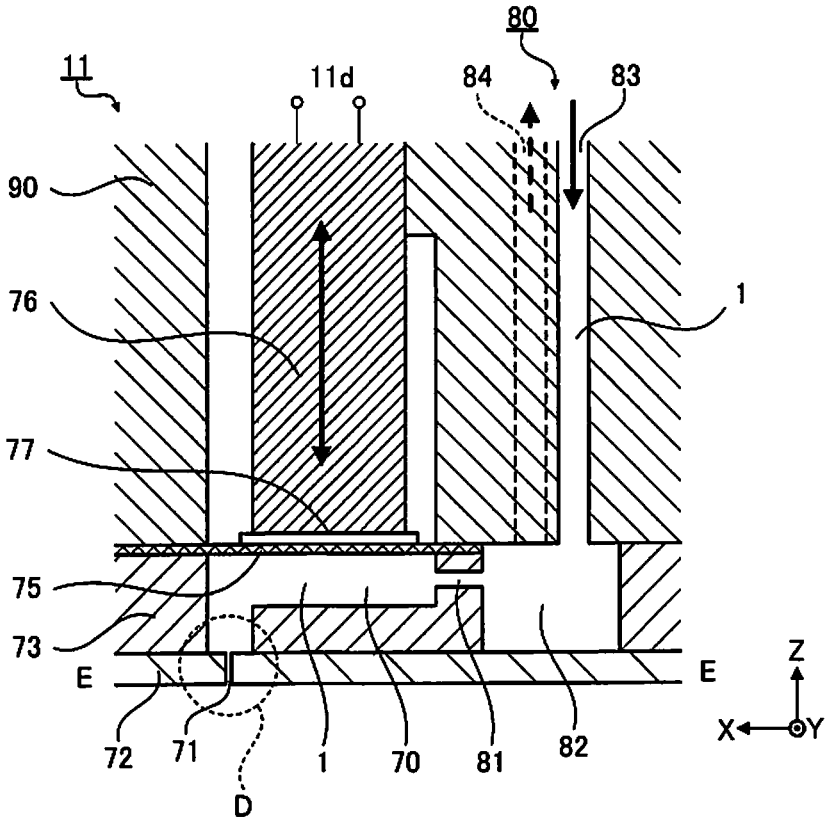
FIG. 3A is a cross sectional diagram.
Figure 3B:
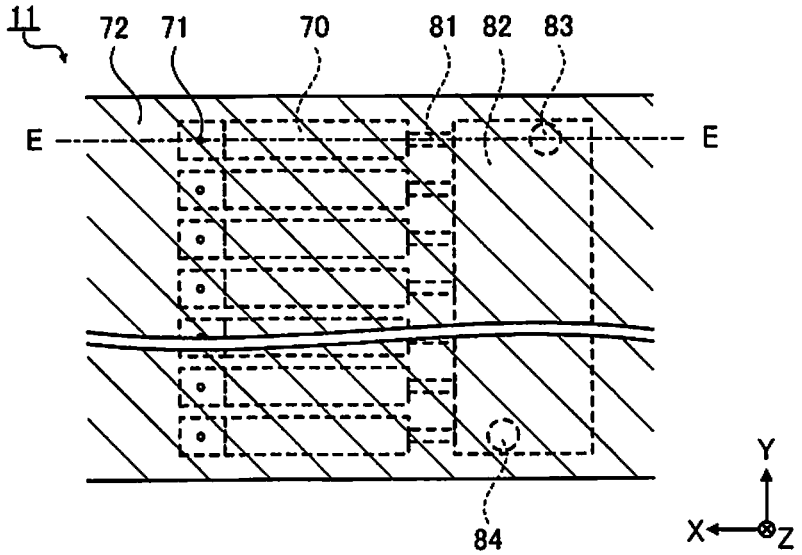
FIG. 3B is planar diagram schematically illustrating a discharge section.

FIG. 3A is a cross sectional diagram and FIG. 3B is planar diagram which schematically illustrate the discharge heads 11 which is the "discharge section". In addition, FIG. 3A is a cross section diagram along E-E in FIG. 3B and FIG. 3B is a planar diagram viewed from the lower surface (in the −Z direction) in FIG. 3A.

The discharge heads 11 are provided with a plurality of cavities 70 which are filled with the ink 1, nozzles 71 which are linked with one lower edge section of the cavities 70 and which discharge the ink 1 which is filled in the cavities 70, a nozzle board 72 on which a plurality of the nozzles 71 are formed, a cavity board 73 on which the plurality of cavities 70 are formed, a vibration plate 75 which configures a ceiling section for the cavities 70, a piezoelectric element 76 which vibrates the vibration plate, a joining plate 77 which joins the vibration plate 75 and the piezoelectric element 76, a head base 90, and the like as a system for discharging the ink 1.

In addition, the discharge heads 11 are provided with linking paths 81 which are linked with the other edge section of the cavities 70, a manifold 82 which supplies the ink 1 to the plurality of linking paths 81, an ink introduction path 83 which circulates and supplies the ink 1 to the manifold 82, an ink ejection path 84 which circulates and eject the ink 1 from the manifold, and the like as a system for supplying the ink 1 to the cavities 70.

The cavities 70 are pressure chambers for discharging the ink 1 from the nozzles 71 as ink droplets. The cavities 70 are substantially rectangular cavities which extend in the X axis direction and the plurality of cavities 70 are formed so as to line up in the Y axis direction using the cavity board 73. The edge section on the +X side of the cavities 70 forms a lower region at the edge section of the cavities 70 which extends in the −Z direction and links with the nozzles 71.

The nozzles 71 are formed with a plurality of through holes which are lined up in the Y axis direction on the nozzle board 72 which extends in the X-Y plane, the cavities 70 and the nozzles 71 are linked by a region of the nozzle board 72 in which the nozzles 71 are formed abutting with the lower region of the edge section of the cavities 70 which are lined up with the same pitch.

The vibration plate 75 is interposed by the cavity board 73 and the head base 90 so as to configure a ceiling section for the cavities 70.

The piezoelectric element 76 is driven by the head driver 11*d* which is controlled to be driven in accordance with control for printing by the control section 50. The piezoelectric element 76 is housed in the head base 90 and an upper edge region of the piezoelectric element 76 is fixed to the head base 90. A lower edge of the piezoelectric element 76 is joined to the vibration plate 75 via the joining plate 77.

The discharge heads 11 discharge the ink 1 which is filled into the cavities 70 from the nozzles 71 which are linked with the cavities 70 due to the capacity of the cavities 70 changing according to vibrating of the vibration plate 75 which is vibrated by the piezoelectric element 76.

Figure 4:
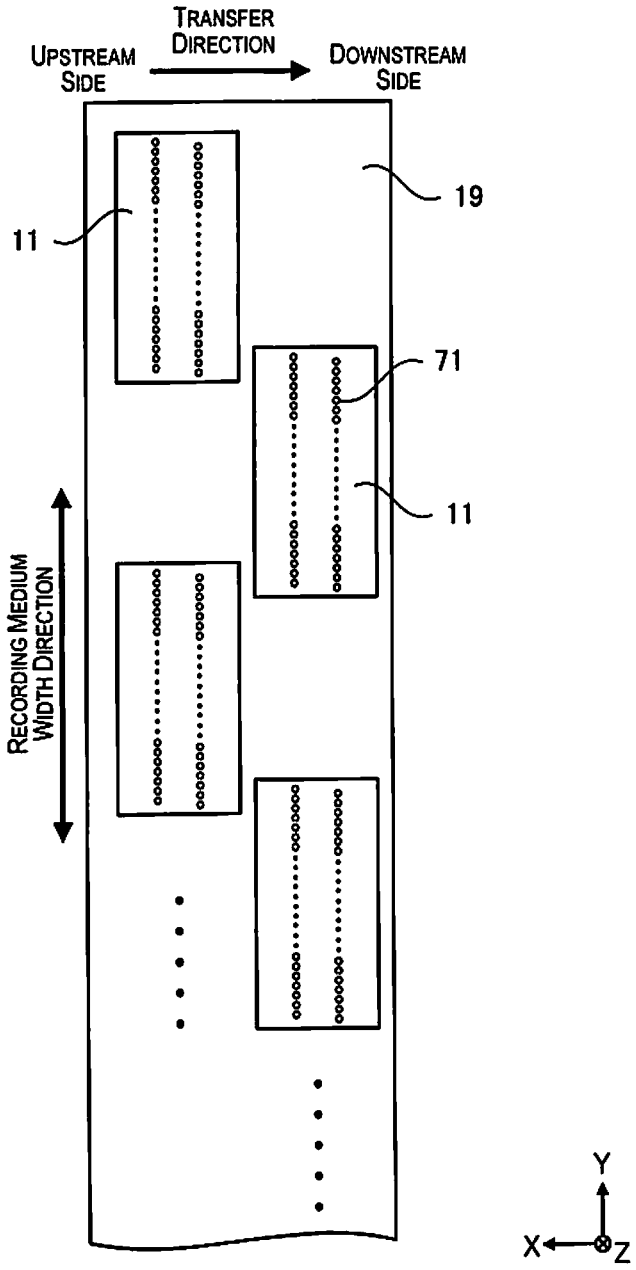
FIG. 4 is a planar diagram illustrating an example of a head unit.

FIG. 4 is a planar diagram illustrating an example of the head units 19, and the head units 19 are shown in a state viewed from the lower surface of the head units 19.

The head unit 19 is provided with a plurality of the discharge heads 11. The plurality of discharge heads 11 are arranged in a zig-zag shape as shown in FIG. 4 so that it is possible to discharge the ink 1 over the entire width direction of the paper roll 2. Here, arranging of the plurality of discharge heads 11 in a zig-zag shape is arranging so that any of the discharge heads 11 (a first discharge section) is arranged so that a portion of the position in the Y direction overlaps and another portion of the position in the Y direction does not overlap with regard to another of the discharge heads 11 (a second discharge section).

In addition, two rows of the nozzles 71 are formed in a zig-zag shape in each of the discharge heads 11. Here, there may be two or more rows of the nozzles 71 and it is sufficient if a plurality of rows of the nozzles 71 are formed in a zig-zag shape. Here, forming a plurality of rows of the nozzles 71 in a zig-zag shape is forming so that any of the rows of the nozzle 71 (a first nozzle row) is formed so that a portion of the position in the Y direction overlaps and a portion of the position in the Y direction does not overlap with regard to another of the rows of the nozzles 71 (a second nozzle row). Due to this, a nozzle pitch of, for example, 720 dpi is realized in the width direction of the paper roll 2 (a direction which intersects with the transfer direction of the paper roll 2).

Figure 5:
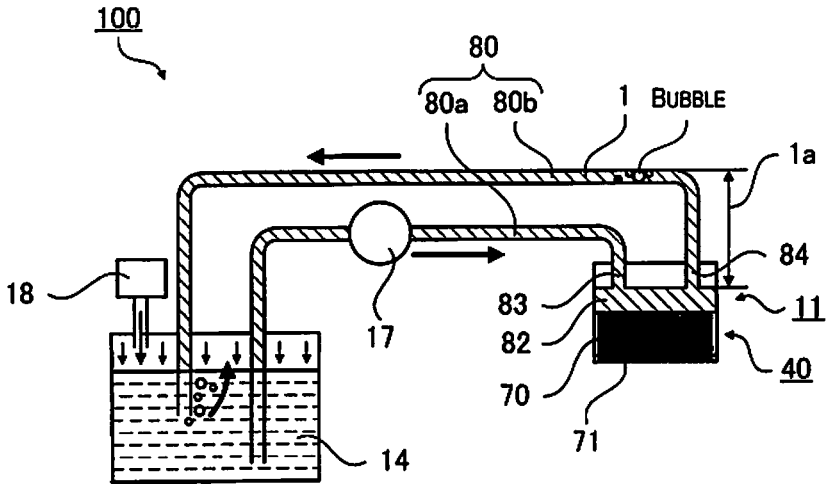
FIG. 5 is schematic diagram illustrating a discharge section and a liquid supply path.

FIG. 5 is schematic diagram illustrating the discharge section (the discharge heads 11) and a liquid supply path (the ink supply path 80).

The ink supply path 80 is a supply path which supplies the ink 1 into the plurality of cavities 70 and is configured by a circulation path which has an outward path 80*a* from the ink tank 14 to the manifold 82 (the ink introduction path 83) and a return path 80*b* from the manifold 82 to the ink tank 14 (the ink ejection path 84). In other words, the ink supply path 80 has a circulation path which includes the outward path 80*a* and the return path 80*b*. In addition, the pump 17 which pumps the ink 1 in the ink supply path 80 is provided in the outward path 80*a*.

It is possible for the pump 17 to change the speed at which the ink 1 is pumped in the ink supply path 80 due to controlling by the control section 50.

As shown in FIG. 5, the ink tank 14 is configured so that the ink 1 is retained in an inner section of the ink tank 14 and the ink 1 in a region where bubbles are not included is sent out to the outward path 80*a*. In addition, the ink tank 14 is provided with the pump 18 which performs control to pressurize the ink 1 in the ink supply path 80.

It is possible for the pump 18 to change the pressure of the ink 1 in the ink supply path 80 due to controlling by the control section 50.

In the ink jet printer 100 which is configured as described above, there are cases where the pressure of the ink 1 in the manifold 82 exceeds a predetermined pressure in a case where bubbles are mixed in the inner section of the ink supply path 80 for any reason. In detail, as shown in FIG. 5, for example, in a case where the return path 80*b* which is from the manifold 82 to the ink tank 14 extends in a direction above the manifold 82, head pressure due to a liquid column 1*a* of the ink 1 which is shown in FIG. 5 has an effect on the ink 1 inside the manifold 82 in a case where a non-negligible bubble is mixed in an upper section. The non-negligible bubble refers to a bubble to the extent where the head pressure has an effect on normal ink discharge in the discharge heads 11.

Figure 6A:
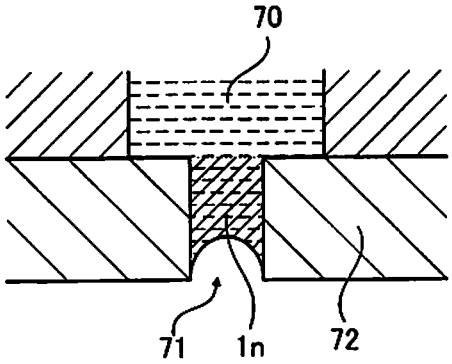
FIGS. 6A to 6C are conceptual diagrams illustrating the relationship between pressure of ink in an ink supply path and a meniscus which is formed in a nozzle.
Figure 6B:
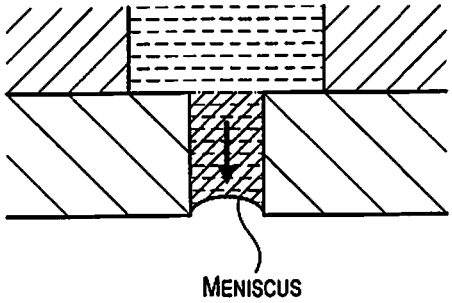
Figure 6C:
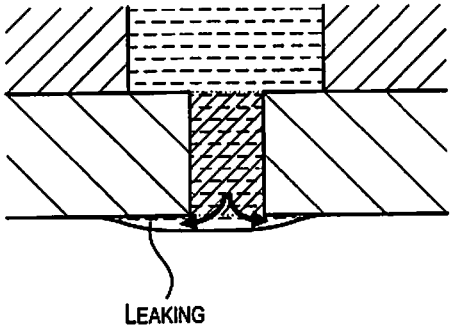

FIGS. 6A to 6C are conceptual diagrams illustrating the relationship between pressure of the ink 1 in the ink supply path 80 and a meniscus which is formed in the nozzle 71.

FIG. 6A shows a meniscus which is formed in the nozzle 71 in a case where the pressure of the ink 1 in the ink supply path 80 is normal (within a predetermined pressure range). The meniscus pressure and the pressure of the ink 1 in the cavities 70 are held in antagonistic equilibrium. With regard to this, when the pressure of the ink 1 in the cavities 70 increases, the position of the meniscus falls (FIG. 6B). When the pressure of the ink 1 in the cavities 70 increases further, it is not possible for the meniscus to be maintained and the ink 1 leaks from the opening of the nozzle 71 to the outside (FIG. 6C). The leaking has an effect on the normal discharge of ink droplets (for example, the amount of ink droplets varies, the discharge angle of the ink droplets changes, and the like) and causes a problem in that ink droplets becoming attached to the medium (the paper roll 2) and the medium becoming unclean.

In a case where the non-negligible bubble described above is mixed or generated in the ink supply path 80, the pressure of the ink 1 in the cavities 70 from the manifold 82 increases and the states which are shown in FIG. 6B and FIG. 6C are observed in the nozzles 71 where a plurality of head units 19 which are shown in FIG. 4 are provided.

As is clear from FIGS. 6A to 6C, the amount of the ink 1 (an ink 1*n*) in the nozzles 71 is different within a range from the normal state to a state where the ink 1 leaks.

That is, the amount of the ink 1 in the nozzles 71 increases in the nozzles 71 where there is leaking of the ink 1. In detail, the amount of the ink 1 (the ink 1*n*) in the nozzles 71 has a relationship where the amount in the state of FIG. 6A is less than the amount in the state of FIG. 6B and the amount in the state of FIG. 6B is less than the amount in the state of FIG. 6C.

Figure 7:
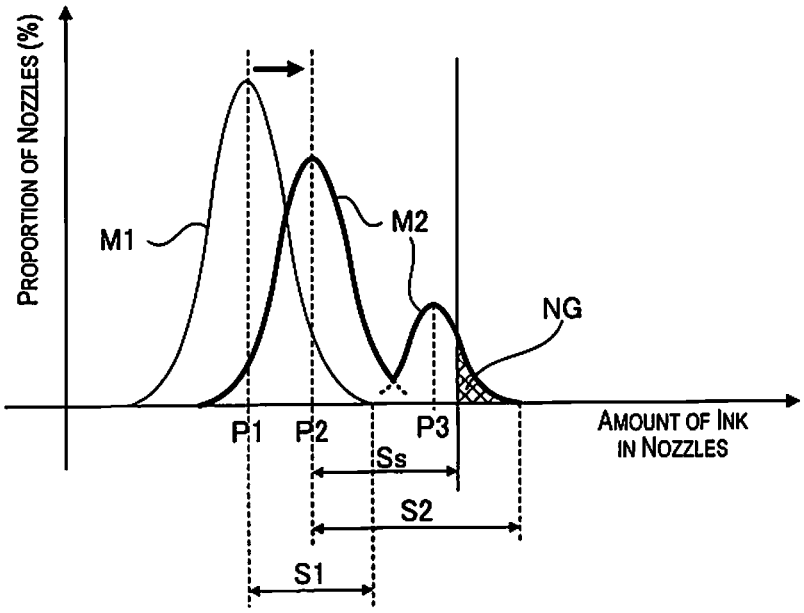
FIG. 7 is a graph illustrating a distribution of the amount of ink which is included in nozzles which are provided in the same head unit.

FIG. 7 is a graph conceptually illustrating a distribution of the amount of the ink 1*n* which is included in the nozzles 71 which are provided in the same head unit 19. The horizontal axis of the graph expresses the amount of ink in the nozzles. The amount of ink in the nozzles is the amount of the ink 1*n* which is included in one of the nozzles 71. In addition, the vertical axis of the graph is the proportion of the number of the nozzles 71 in a location on the horizontal axis (the amount of ink in the nozzles) out of the total number of the nozzles 71 which are included in one of the head units 19. Here, the vertical axis expresses this as the proportion of nozzles with the proportion as a percentage (%).

The graph expresses variation in the amount of ink in the nozzles 71 which are included in one of the head units 19. The extent to which the width of the graph is spread out over the horizontal axis has the meaning of the amount of variation in the amount of ink in the nozzles. In addition, the shape of the graph is preferably a shape where there is one large peak and is preferably not a shape where there are a plurality of peaks. This is because a plurality of peaks being possible has the meaning that there are a plurality of groups of the nozzles 71 which are exhibiting a certain amount of ink in the nozzles and the variation in the amount of ink in the nozzles is large. Here, in the graph, the value of the amount of ink inside the nozzles which exhibits the highest percentage of nozzles is the mode. The mode is the most common value for the amount of ink in the nozzles out of the amounts of ink in each of the nozzles 71 in the head units 19.

A distribution M1 is a distribution of the amount of the ink 1*n* in a normal state. In contrast to this, a distribution M2 is a distribution of the amount of the ink 1*n* when there is leaking of the ink 1 from a portion of the nozzles 71 as a result of bubbles being included in the ink supply path 80.

The value of the mode from the distribution M1 to the distribution M2 shifts from P1 to P2. In addition, peaks at two locations of P2 and P3 are observed in the distribution M2. In addition, in comparison to the width on the horizontal axis of the distribution of the amount of the ink 1*n* in the normal state (a distribution width S1 from the peak P1 to the largest value), the width on the horizontal axis of the distribution of the amount of the ink 1*n* when there is leaking of the ink 1 (a distribution width S2 from the peak P2 to the largest value) is larger.

In a case where the non-negligible bubble described above is included in the ink supply path 80, the inventor of the present application found a phenomenon with such tendencies appeared and that it is possible to identify the normal state or a state which is to be detected as an abnormality.

A method for detecting abnormalities is, in detail, setting a threshold width Ss. The threshold width Ss is a value between the distribution width S1 and the distribution width S2. Then, the method is a method for determining whether there is an abnormality in the ink supply path 80 in a case where the distribution of the amount of the ink 1*n* which is included (filled into) the nozzles 71 which are provided in the head units 19 is measured and there is the nozzles 71 which include the ink 1*n* with an amount which is distributed to be at a position where the threshold width Ss from the mode P2 is exceeded.

Here, the method for determining abnormalities is not limited to determining whether or not the nozzles 71 exceed the threshold width Ss, but may be a method for determining abnormalities in a case where the percentage of nozzles 71 which exceed the threshold width Ss (a proportion in an NG region in FIG. 7) exceeds a predetermined value (for example 5%).

Since the distribution M1 and the distribution M2 are different due to the specifications of the discharge heads 11 or the ink supply path 80, the specifications of the ink 1, and the like, it is preferable that the threshold width Ss and the proportion in a permissible NG region which are for detecting abnormalities be set to appropriately evaluate the state of the ink jet printer 100.

Next, a method for measuring and evaluating the distribution of the amount of the ink 1*n* will be described.

As shown in FIGS. 6A to 6C, when the amount of the ink 1*n* in the nozzles 71 changes, inertance of the ink 1*n* in the nozzles 71 changes and there is a change in the way in which the vibration plate 75 vibrates in the cavities 70 which are linked to the nozzles 71. Accordingly, a method of evaluating the vibrating of the vibration plate 75 is one method for measuring the distribution of the amount of the ink 1*n*. In detail, as shown below, the method is performed by evaluating the residual vibration frequency (or period) of the vibration plate 75 in the cavities 70.

Figure 8:
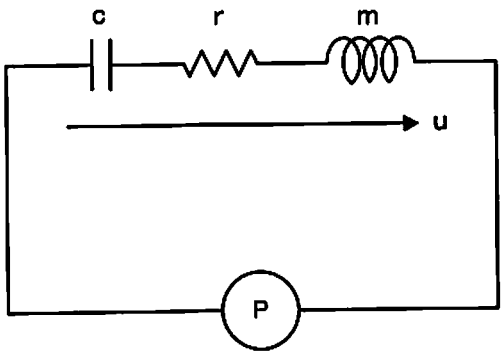
FIG. 8 is an equivalent circuit diagram of simple vibration which is assumed as residual vibration in a vibration plate.

FIG. 8 is an equivalent circuit diagram of simple vibration which is assumed as residual vibration in the vibration plate 75.

P is the pressure which is imparted to the ink 1 in the cavities 70, m is the inertance of the ink 1 in the cavities 70 and the nozzles 71, c is the compliance of the vibration plate 75, r is the flowpath resistance, and u is the volumetric speed as a step response when the pressure P is imparted.

Free vibration (residual vibration) with regard to the vibration (movement) of the vibration plate 75 is given by the calculation model shown below in equation 1.

$$u = \frac{P}{\omega \cdot m} e^{-\alpha t} \cdot \sin \omega t \quad (1)$$

$$\omega = \sqrt{\frac{1}{m \cdot C} - \alpha^2} \quad (2)$$

$$\alpha = \frac{r}{2m} \quad (3)$$

Figure 9:
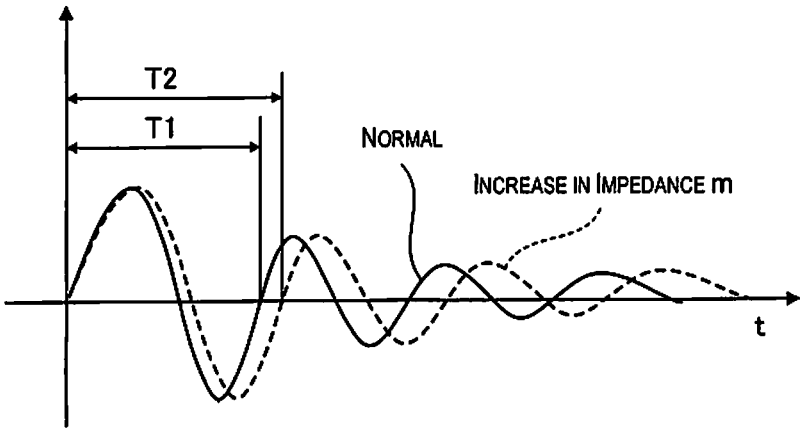
FIG. 9 is a graph illustrating the relationship between inertance and a residual vibration waveform.

FIG. 9 is a graph illustrating the relationship between the inertance m and a residual vibration waveform. The horizontal axis of the graph expresses time and the vertical axis expresses the size of the residual vibration.

For example, in a case where a non-negligible bubble is included in the ink supply path 80 and the amount of the ink 1*n* in the nozzles 71 increases as a result, the period of the residual vibration increases due to the inertance m which increases in accompaniment with the increase in the amount of the ink 1*n* in the nozzles 71. In detail, a period T1 (frequency f1=1/T1) when the impedance m is normal changes to a period T2 (frequency f2=1/T2) when the impedance m increases.

Accordingly, the period (frequency) of the residual vibration is measured and it is possible to evaluate the distribution of the amount of the ink 1*n* by evaluating the distribution of the period of the residual vibration. In order to detect abnormalities, the distribution of the period (frequency) of the residual vibration is evaluated and the threshold width Ss and the proportion in the permissible NG region which are for detecting abnormalities are set.

Figure 10:
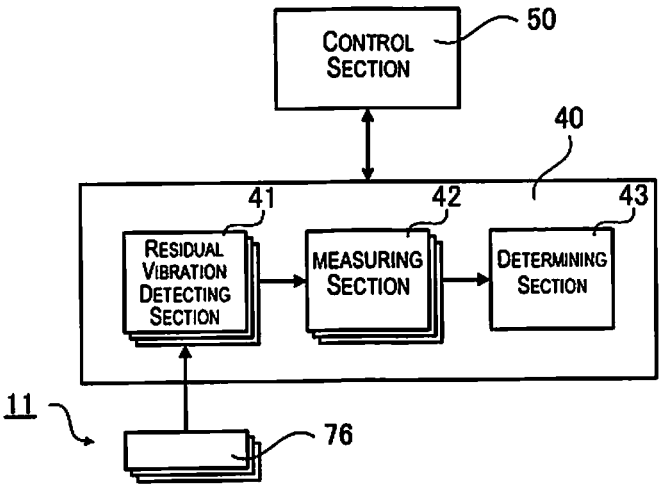
FIG. 10 is a block diagram of a detecting section.

FIG. 10 is a block diagram which describes the detecting section 40.

The detecting section 40 is a portion which detects the state of the ink supply path 80 by detecting the state of the ink 1 in the discharge heads 11 and is configured from a residual vibration detecting section 41, a measuring section 42, a determining section 43, and the like. The residual vibration detecting section 41 and the measuring section 42 are provided together in the individual nozzles 71.

Figure 11:
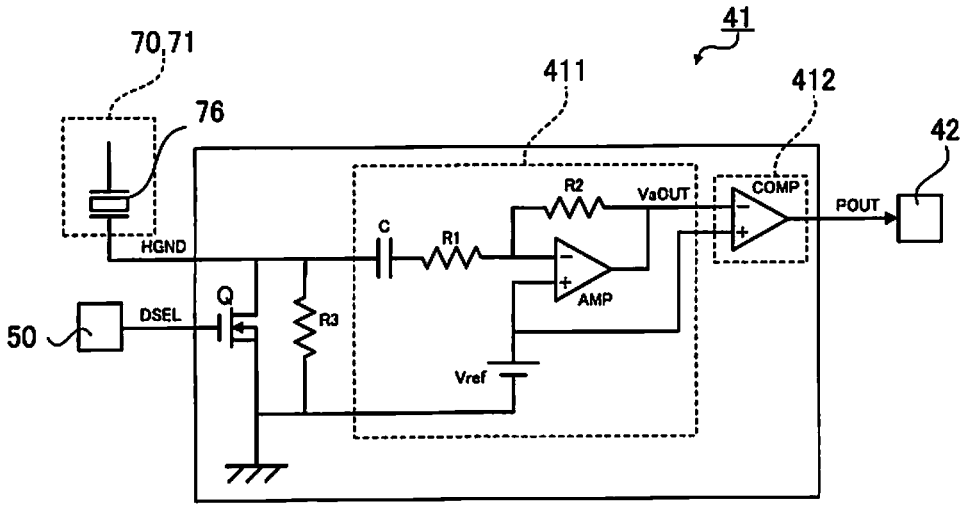
FIG. 11 is a circuit diagram illustrating an example of a residual vibration detecting section.

FIG. 11 is a circuit diagram illustrating an example of the residual vibration detecting section 41.

The residual vibration detecting section 41 is a portion which detects residual vibration using changes in pressure in the ink 1 in the cavities 70 being transferred to the piezoelectric element 76. In detail, the residual vibration detecting section 41 detects changes in electromotive force (electromotive pressure) which are generated due to the mechanical displacement of the piezoelectric element 76.

The residual vibration detecting section 41 is configured so as to include a transistor Q, an AC amplifier 411, a comparator 412, and the like.

The transistor Q is a switch which grounds or opens a ground terminal (an HGND application side) of the piezoelectric element 76 and a gate voltage (a gate signal DSEL) of the transistor Q is controlled by the control section 50. A resistor R3 is provided to suppress rapid changes in voltage during switching of the transistor Q between on and off.

The AC amplifier 411 is configured by a capacitor C which removes a DC component and a computing unit AMP which reverses and amplifies with an amplification factor which is determined using resistors R1 and R2 with the potential of a reference voltage Vref at as reference. The AC amplifier 411 amplifies the AC component of the residual vibration which is generated due to opening of the ground terminal after a pulse of a driving signal is applied to the piezoelectric element 76.

The comparator 412 is a comparator, which compares a residual vibration VaOUT which is amplified and the reference voltage Vref, and outputs a pulse POUT at a period according to the residual vibration.

When the gate signal DSEL is at a high level, the transistor Q is on, the ground terminal of the piezoelectric element 76 is in a grounded state, and the driving signal is supplied to the piezoelectric element 76. Alternatively, when the gate voltage (the gate signal DSEL) of the transistor Q is at a low level, the transistor Q is off and the electromotive force of the piezoelectric element 76 is transmitted to the residual vibration detecting section 41.

The residual vibration detecting section 41 outputs the pulse POUT to the measuring section 42 at a period according to the residual vibration VaOUT where an electromotive force signal is amplified depending on the residual vibration.

The description will return to FIG. 10.

The measuring section 42 measures the period of the pulse POUT at a period according to the residual vibration and a measurement value is transmitted to the determining section 43.

The determining section 43 collects the measurement values of the residual vibration under the control of the control section 50 and detects the state of the ink supply path 80 by evaluating the distribution of the measurement values. The determining section 43 transmits the result, where the state of the ink supply path 80 is detected, to the control section 50.

Here, there may be a configuration where the function of the determining section 43 is provided in the control section 50 and the control section 50 evaluates the distribution of the amount of the ink 1*n*. That is, there may be a configuration where measurement results from the measuring section 42 are collected by the control section 50 and the state of the ink supply path 80 is detected by the control section 50 evaluating the distribution of the measurement results.

In addition, the method for measuring and evaluating the distribution of the amount of the ink 1*n* is not limited to a method using the detecting section 40. It is sufficient if it is possible to quantify the amount of the ink 1*n* using the method and, for example, there may be a method where the position of the meniscus which is formed in the nozzle 71 is optically detected, a method where resistance between electrodes which conduct due to the ink 1*n* which is filled into the nozzle 71 is electrically detected, or the like.

Next, a method for detecting the state of the ink supply path 80 in the ink jet printer 100, the results from evaluating the state, and the operation of the ink jet printer 100 in a case where an abnormality is detected will be described.

Detecting of the state of the ink supply path 80 in the ink jet printer 100 is performed in a case where the discharge heads 11 (the head units 19) are moved to the non-recording and discharging region B (refer to FIG. 1B). That is, the state of the ink supply path 80 is detected before the discharge heads 11 (the head units 19) start moving from the non-recording and discharging region B (the standby position) to another position.

Here, the state is evaluated and analyzed, and the threshold width Ss and an NG percentage which is the proportion of the nozzles 71, which exceed the threshold width Ss and which are to be determined as an abnormality, are stored in advance in the memory section of the control section 50 in order to detect abnormalities. In addition, the following operation is performed under control of the control section 50.

First, the discharge heads 11 (the head units 19) are moved to the non-recording and discharge region B by the head moving mechanism 12.

Next, the distribution of the amount of the ink 1*n* which is filled into the nozzles 71 is measured and the state of the ink supply path 80 is detected based on the distribution using the detecting section 40. In detail, the period of the residual vibration in the vibration plate 75 which corresponds to all of the nozzles 71 is measured and the distribution of the period, which reflects the distribution of the amount of ink 1*n*, is observed. The mode of the distribution is determined by the determining section 43 or the control section 50 which is provided with the function of the determining section 43, and the proportion of the nozzles 71, which are distributed at a position where the threshold width Ss is exceed with regard to the mode, is compared with the NG percentage.

In a case where it is determined that there is an abnormality even in a case where there is one of the nozzles 71 with an amount of the ink 1*n* where the threshold width Ss is exceeded with regard to the mode, it is checked whether or not there is the nozzle 71 with an amount of the ink 1*n* where the threshold width Ss is exceeded with regard to the mode.

In a case where the proportion of the nozzles 71, which are distributed at a position where the threshold width Ss is exceed with regard to the mode, is lower than the NG percentage, the determining section 43 or the control section 50 which is provided with the function of the determining section 43 determines that the state of the ink supply path 80 is normal and transitions to a desired operation. The desired operation includes an operation where the discharge heads 11 (the head units 19) are moved to the recording and discharging region A by the head moving mechanism 12 and image recording onto the paper roll 2 is started.

In a case where it is determined that there is an abnormality even in a case where there is one of the nozzles 71 with an amount of the ink 1*n* where the threshold width Ss is exceeded with regard to the mode, it is determined that the state of the ink supply path 80 is normal in a case where there is not any of the nozzles 71 with an amount of the ink in where the threshold width Ss is exceeded with regard to the mode and the same operation is performed.

In a case where the proportion of the nozzles 71, which are distributed at a position where the threshold width Ss is exceed with regard to the mode, is the same as or higher than the NG percentage, the determining section 43 or the control section 50 which is provided with the function of the determining section 43 determines that the state of the ink supply path 80 is abnormal and transitions to an operation where abnormalities are dealt with.

In a case where it is determined that there is an abnormality even in a case where there is one of the nozzles 71 with an amount of the ink 1*n* where the threshold width Ss is exceeded with regard to the mode, there is a transition to an operation where abnormalities are dealt with in the same manner in a case where there is the nozzle 71 with an amount of the ink 1*n* where the threshold width Ss is exceeded with regard to the mode.

The operation will be described with reference to FIG. 5.

Dealing with abnormalities (processing for recovering to the normal state) works on the premise that the cause for an abnormality is that there are bubbles which are included in the ink supply path 80 and is performed as an operation where the bubbles are removed. In detail, first, driving pressure (or driving speed) of the pump 17 is increased and speed for pumping of the ink 1 in the ink supply path 80 is increased. That is, flow speed of the ink 1 in the ink supply path 80 is increased. Due to the speed for pumping of the ink 1 in the ink supply path 80 being increased, the bubbles which are included in the inner section of the ink supply path 80 are circulated in the circulation path and it is possible to move the bubbles to the ink tank 14. It is preferable that the time over which the increase in the speed for pumping is maintained be a time for circulation of the ink 1 to be sufficiently performed and which is sufficient to complete moving of the bubbles, which are thought to be included in the ink supply path 80, to the ink tank 14. As shown in FIG. 5, the bubbles which are moved to the ink tank 14 are eliminated due to the bubbles floating to the surface of the ink 1 in the ink tank 14.

Furthermore, driving pressure of the pump 18 is increased and the ink 1 which is filled into the ink supply path 80 is pressurized as a means of dealing with the abnormality. Pressurizing is performed to the extent that the ink 1 in the cavities 70 is sufficiently discharged from the nozzles 71 via the manifold 82. It is possible to eject the bubbles, which move from within the circulation path to the cavities 70 and the nozzles 71, from the nozzles 71 by pressurizing and sufficiently discharging the ink 1 in the cavities 70 from the nozzles 71. In addition, leaking from opening sections of the nozzles 71 is alleviated. The ink 1 which is discharged from the nozzles 71 is discharged to the ink recovery section 15 which is provided in the non-recording and discharging region B.

Dealing with these abnormalities is performed and the state of the ink supply path 80 is detected (observed) again. As a result, there is a transition to a desired operation in a case where it is determined that the state of the ink supply path 80 returns to normal. In a case where an abnormality is detected again, the control section 50 performs the operation for dealing with abnormalities again or notifies that there is an error according to content which is set in advance in the control section 50.

As described above, it is possible to obtain the following effects due to the liquid discharge apparatus and the liquid supply path state detection method according to the present embodiment.

The ink jet printer 100 is provided with the plurality of cavities 70 which are filled with the ink 1, the ink supply path 80 which supplies the ink 1 to the cavities 70, and the nozzles 71 which are linked with the cavities 70 and which discharge the ink 1 which is filled into the cavities 70. In this configuration, in a case where the pressure, which is applied to the ink 1 which is filled into the cavities 70 from the ink supply path 80, exceeds a predetermined pressure, the amount of the ink 1 which is filled into the nozzles 71 exceeds a predetermined amount so that the position and the form of the meniscuses which are formed in the nozzles 71 changes and the ink 1 leaks from the nozzles 71 without the meniscuses which are formed being maintained. In this manner, in a case where there is an abnormality in the ink supply path 80, the distribution of the amount of the ink 1 in the nozzles 71 which span the plurality of nozzles 71 exhibits a distribution which is different to normal as a result.

The ink jet printer 100 is provided with the detecting section 40 which measures the distribution of the amount of the ink 1 which is filled into the plurality of nozzles 71 and detects the state of the ink supply path 80 based on the distribution which is measured. In other words, the detecting section 40 detects the state of the ink supply path 80 based on the amount of the ink 1 which is filled into the plurality of nozzles 71. For this reason, it is possible to detect an abnormality in pressure in the ink supply path 80 using the detecting section 40 in a case where the distribution is different from normal.

In other words, the liquid discharge apparatus is provided with the cavities 70 which are filled with the liquid, the liquid supply path which supplies the liquid to the cavities 70, the nozzles 71 which are linked with the cavities 70 and which discharges the liquid which is filled into the cavities 70, and the detecting section 40 which detects the state of the liquid supply path based on the amount of the liquid which is filled into the plurality of the nozzles 71. In this configuration, the liquid leaks from a portion of the nozzles 71 in a case where there is any abnormality in the liquid supply path. At this time, the amount of the liquid in the nozzles 71 in the portion of the nozzles 71 where the liquid leaks is different to the amount of the liquid in the many other nozzles 71. Accordingly, it is possible to detect abnormalities in the liquid supply path by detecting the state of the liquid supply path based on the amount of the liquid which is filled into the nozzles 71.

In addition, the ink jet printer 100 is provided with the discharge heads 11 which discharge the ink 1 which is filled into the cavities 70 from the nozzles 71 which are linked with the cavities 70 due to the capacity of the cavities 70 changing according to vibrating of the vibration plate 75 which is vibrated by the piezoelectric element 76, the ink tank 14 which retains the ink 1, the ink supply path 80 which supplies the ink 1 from the ink tank 14 to the cavities 70, and the head driver 11*d* which drives the piezoelectric element 76. In a case where there is an abnormality in the ink supply path 80 (an abnormality where a predetermined pressure is exceeded), the distribution of the amount of the ink 1 in the nozzles 71 which span the plurality of nozzles 71 exhibits a distribution which is different to normal as a result. When the amount of the ink 1 in the nozzles 71 changes, inertance of the ink 1 in the nozzles 71 changes and there is a change in the residual vibration in the vibration plate 75 (the residual vibration pattern of the vibration plate 75) in the cavities 70 which are linked to the nozzles 71.

The ink jet printer 100 is provided with the detecting section 40 which detects the state of the ink supply path 80 based on the residual vibration in the vibration plate 75. For this reason, it is possible to detect an abnormality in pressure in the ink supply path 80 using the detecting section 40 in a case where the amount of the ink 1 in the nozzles 71 is different to normal. In addition, it is possible to provide the ink jet printer 100 which is able to detect the state of the ink supply path 80 without newly providing an apparatus which detects the state of the ink supply path 80 or the like since it is possible for the detecting section 40 to be configured to be provided with a detecting circuit which is used as a means for detecting the piezoelectric element 76 which vibrates the vibration plate 75.

In other words, the liquid discharge apparatus is provided with the discharge section which discharges the liquid which is filled into the cavities 70 due to the capacity of the cavities 70 changing according to vibrating of the vibration plate 75 which is vibrated by the piezoelectric element 76, the retaining section which retains the liquid, the liquid supply path which supplies the liquid from the retaining section to the plurality of the cavities 70, and the detecting section 40 which detects the state of the liquid supply path based on residual vibration in the vibration plate 75. In this configuration, liquid leaks from a portion of the nozzles 71 in a case where there is any abnormality in the liquid supply path. At this time, the amount of the liquid in the nozzles 71 in the portion of the nozzles 71 where the liquid leaks is different to the amount of the liquid in the many other nozzles 71. When the amount of the liquid in the nozzles 71 changes, inertance of the liquid in the nozzles 71 changes and there is a change in the residual vibration in the vibration plate (the residual vibration pattern of the vibration plate) in the cavities which are linked to the nozzles 71. Accordingly, it is possible to detect an abnormality in the liquid supply path by detecting the state of the liquid supply path based on the residual vibration in the vibration plate.

In addition, there is a change in the period of the residual vibration with regard to vibrating of the vibration plate 75, where the capacity of the cavities 70 which are linked with the nozzles 71 changes, when there is a change in the inertance of the ink 1 which is filled into the nozzles 71. For this reason, as in the present embodiment, it is understood that changes in the inertance of the ink 1 which is filled into the nozzles 71 (that is, changes in the amount of the ink 1 which is filled into the nozzles 71) due to observing of variation in the period of the residual vibration. That is, it is possible to more simply detect changes in the state of the ink supply path 80 which produces these changes.

In addition, the detecting section 40 detects the state of the ink supply path 80 before the discharge heads 11 start moving from the non-recording and discharging region B to another position. For this reason, in a case where, for example, an abnormality in pressure in the ink supply path 80 is detected, there is a danger that the ink 1 leaks from the nozzles 71 or the like, but since this occurs before starting movement of the discharge heads 11 from the non-recording and discharging region B to another position, it is possible to take precautions against the medium becoming unclean due to the ink 1 which leaks and locations outside of the non-recording and discharging region B becoming unclean.

In addition, the ink supply path 80 has the circulation path which includes the outward path 80*a* from the ink tank 14 to the manifold 82 and the return path 80*b* from the manifold 82 to the ink tank 14, and the pump 17 pumps the ink 1 in the circulation path. In addition, the pump 17 increases the speed for pumping of the ink 1 in a case where the detecting section 40 determines that the state of the ink supply path 80 is abnormal. Accordingly, in a case where, for example, bubbles are included in the ink supply path 80 and the detecting section 40 detects an abnormality in the ink supply path 80 which is caused by the bubbles (an abnormality where a predetermined pressure is exceeded), it is possible to circulate the bubbles which are included in an inner section of the ink supply path 80 within the circulation path and move the bubbles to the ink tank 14 by increasing the speed for pumping of the ink 1 in the ink supply path 80. As a result, it is possible to return the state of the ink supply path 80 to a favorable state.

In addition, the pump 18 pressurizes the ink 1 which is filled into the ink supply path 80 in a case where the detecting section 40 determines the state of the ink supply path 80 is abnormal. Accordingly, in a case where, for example, bubbles are included in the ink supply path 80 and the detecting section 40 detects an abnormality in the ink supply path 80 which is caused by the bubbles (an abnormality where a predetermined pressure is exceeded), it is possible to eject bubbles, which move from the circulation path to the cavities 70 and the nozzles 71, from the nozzles 71 by pressurizing the ink 1 which is filled into the ink supply path 80. As a result, it is possible to return the state of the ink supply path 80 to a favorable state in combination with eliminating bubbles from within the circulation path.

As described above, according to the ink jet printer 100 of the present embodiment, the liquid discharge apparatus is configured so that it is possible to simply detect leaking of ink from the nozzles and the like which is caused by an abnormality in pressure in the ink supply path.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

a cavity configured to be filled with a liquid;

a liquid supply path configured to supply the liquid to the cavity;

a discharge section having a plurality of nozzles which are linked with the cavity and are configured to discharge the liquid which is filled into the cavity; and a detecting section configured to perform measurements of amount of the liquid in the nozzles, respectively, determine a distribution of the measurements, and detect a state of the liquid supply path based on the distribution of the measurements.

2. The liquid discharge apparatus according to claim 1, wherein the discharge section is configured to discharge the liquid due to a change in a capacity of the cavity according to a vibration of a vibration plate, and the detecting section is configured to detect the state of the liquid supply path based on residual vibration in the vibration plate.

3. The liquid discharge apparatus according to claim 2, wherein the detecting section is configured to detect the state of the liquid supply path based on a period of the residual vibration.

4. The liquid discharge apparatus according to claim 2, wherein the discharge section is further configured to move to a standby position in a case where the liquid is not discharged onto a medium, and the detecting section is configured to detect the state of the liquid supply path before starting movement of the discharge section from the standby position to another position.

5. A liquid discharge apparatus comprising:

a cavity configured to be filled with a liquid;

a liquid supply path configured to supply the liquid to the cavity;

a discharge section which is linked with the cavity and is configured to discharge the liquid which is filled into the cavity;

a detecting section configured to detect a state of the liquid supply path based on an amount of the liquid which is filled into the discharge section, the discharge section being configured to discharge the liquid due to a change in a capacity of the cavity according to a vibration of a vibration plate, the detecting section being configured to detect the state of the liquid supply path based on residual vibration in the vibration plate;

a retaining section configured to retain the liquid;

a manifold linked with the cavities; and a pump configured to pump the liquid which is filled into the liquid supply path, the liquid supply path having a circulation path which includes an outward path from the retaining section to the manifold and a return path from the manifold to the retaining section, the pump being further configured to increase a speed for pumping of the liquid in a case where the detecting section determines that the state of the liquid supply path is abnormal.

6. A liquid discharge apparatus comprising a cavity configured to be filled with a liquid;

a liquid supply path configured to supply the liquid to the cavity;

a discharge section which is linked with the cavity and is configured to discharge the liquid which is filled into the cavity; and a detecting section configured to detect a state of the liquid supply path based on an amount of the liquid which is filled into the discharge section, the discharge section being configured to discharge the liquid due to a change in a capacity of the cavity according to a vibration of a vibration plate, the detecting section being configured to detect the state of the liquid supply path based on residual vibration in the vibration plate, the discharge section being configured to move to a standby position in a case where the liquid is not discharged onto a medium, the detecting section begin configured to detect the state of the liquid supply path before starting movement of the discharge section from the standby position to another position; and a pressurizing section configured to pressurize the liquid which is filled into the liquid supply path, the pressurizing section being configured to pressurize the liquid which is filled into the liquid supply path in a case where the detecting section determines the state of the liquid supply path is abnormal.

7. A liquid supply path state detection method for a liquid discharge apparatus, which includes a cavity configured to be filled with a liquid, a liquid supply path configured to supply the liquid to the cavity, and a discharge section having a plurality of nozzles which are linked with the cavity and are configured to discharge the liquid which is filled into the cavity, the method comprising:

performing measurements of amount of the liquid in the nozzles, respectively;

determining a distribution of the measurements; and detecting a state of the liquid supply path based on the distribution of the measurements.

8. The liquid supply path state detection method for the liquid discharge apparatus according to claim 7, further comprising discharging by the discharge section the liquid due to a change in a capacity of the cavity according to a vibration of a vibration plate, wherein the detecting includes detecting a state of the liquid supply path based on residual vibration in the vibration plate.

* * * * *